United States Patent [19]

Thomas et al.

[11] 4,087,243

[45] May 2, 1978

[54] POLYMER-PRINTED FABRIC AND METHOD FOR PRODUCING SAME

[75] Inventors: Manuel Andrew Thomas; Jerry Albert Cogan, Jr., both of Spartanburg, S.C.

[73] Assignee: Milliken Research Corporation, Spartanburg, S.C.

[21] Appl. No.: 770,880

[22] Filed: Feb. 22, 1977

[51] Int. Cl.[2] ..... D06M 15/52; D06M 15/60; D06P 5/22

[52] U.S. Cl. ..... 8/31; 8/14; 8/66; 8/DIG. 7

[58] Field of Search ..... 8/14, 31, 66, DIG. 7

[56] References Cited

U.S. PATENT DOCUMENTS

| | | | |
|---|---|---|---|
| 1,837,686 | 12/1931 | Spencer | 8/66 |
| 3,227,510 | 1/1966 | Bridgeford | 8/14 |
| 3,652,198 | 3/1972 | Farber et al. | 8/15 |
| 3,743,477 | 7/1973 | Egli et al. | 8/66 |
| 3,989,453 | 11/1976 | Jilla | 8/66 |

FOREIGN PATENT DOCUMENTS

| | | | |
|---|---|---|---|
| 551,693 | 3/1943 | United Kingdom | 8/31 |

*Primary Examiner*—John Kight, III

*Attorney, Agent, or Firm*—Glen M. Burdick; H. William Petry

[57] ABSTRACT

Polymer-printed fabrics are produced by applying to a textile fabric substrate, in a pre-determined pattern, a non-aqueous admixture consisting essentially of at least 1 weight percent of an acid dyeable polymer having a cationic charge in milliequivalents/gram of polymer of from about 0.01 to about 5. The non-aqueous admixture is further characterized as having a viscosity of from about 5 to about 50,000 centipoise. The printed substrate is then heated to a temperature sufficient to dry the polymer printed substrate. Thereafter, the dryed polymer printed substrate is dyed with a dye admixture containing an acid dyestuff preferential to the polymer printed portion of the substrate.

18 Claims, No Drawings

POLYMER-PRINTED FABRIC AND METHOD FOR PRODUCING SAME

This invention relates to a novel polymer-printed fabric and more particularly relates to a new polymer-printed fabric having differential dyeing characteristics. In one aspect it relates to an improved method for producing polymer-printed fabrics having differential dyeing characteristics.

Conventionally, multi-colored or multi-shade fabrics have been produced by knitting or weaving yarns which had been dyed different colors. However, the use of dyed yarns is considerably less desirable because of the extra cost involved in yarn dyeing and the limitations that the colors must be selected prior to the formation of the fabric.

Also, it has been proposed to use yarns with different dyeing characteristics. For example, a mixture of polyamide and polyester yarns may provide a differential color effect with certain dyes. However, this method is limited in the same way as the yarn-dyed fabrics in that the pattern must be introduced during the knitting or weaving operation.

British Pat. No. 1,337,702 discloses a process for providing fabrics with the capability of being dyed in multi-colored effects by applying to pre-determined places on a textile a colorless preparation containing an organic solution or an aqueous dispersion of an acrylic acid ethyl ether capable of being crosslinked and a crosslinking substance based on melamine-formaldehyde. While the process of the patent produces multi-color effect, the use of such resins and crosslinking agents have required the use of cationic or basic dyes. Such cationic dyes are less light stable, less durable and more expensive than the normal acid dyes. Thus, products produced using cationic or basic dyes often suffer from the disadvantages of not being stable to light, not washable in normal laundry procedures, and are expensive to manufacture.

According to the present invention, novel fabrics are provided which possess a pleasantly soft hand and which can be dyed to produce multi-color or multi-shade fabrics. Further according to the invention, an improved method for producing polymer-filled fabrics having differential dyeing characteristics is provided which comprises applying to a textile substrate, in a pre-determined pattern, a non-aqueous admixture containing at least 1 weight percent of an acid dyeable polymer having a cationic charge in milliequivalents/gram of polymer of from about 0.01 to about 5. The textile fabric substrate printed with the non-aqueous admixture is thereafter subjected to elevated temperatures for a period of time effective to dry the polymer and to insure crosslinking of the polymer and bonding of same with the textile substrate. The dried polymer printed substrate is thereafter contacted with a dye admixture containing an acid dyestuff preferential to the polymer printed portion of the printed substrate.

The fabric to which the non-aqueous admixture is applied as a pre-determined pattern can be a woven or knitted fabric. The fabric may be constructed of natural, synthetic or polymer fibers such as cotton, rayon, polyester, polyamide, polyacrylic and the like. Preferred fabrics are constructed from polyester fibers and blends of such fibers either in the individual yarns or in combinations of different yarns. The yarns employed to produce the textile fabric substrate may also be continuous filaments or spun yarns.

After selection of the desired makeup of the textile fabric substrate, the polymer constituents can be applied thereto, in a pre-determined pattern, by any suitable means well known in the art, such as by the use of engraved rolls or printing screen techniques. Any other suitable means of applying the non-aqueous admixture containing the polymeric constituents to the textile fabric substrate can be employed. However, especially desirable results have been obtained when the non-aqueous admixture containing the acid dyeable polymeric component is applied to the textile substrate by the use of a rotary screen printing technique.

The polymer-printed fabric of the present invention having differential dyeing characteristics are produced by applying to the textile substrate, in a pre-determined pattern, a non-aqueous admixture consisting essentially of at least 1 weight percent, based upon the weight of the mix, of an acid dyeable polymer. The term "acid dyeable polymer" as used herein is to be understood to mean any film forming polymer containing cationic sites attached to the polymer as terminating or internal groups. However, the degree and availability of the cationic sites must be of such a degree than the anionic dyes, e.g. acid dyes, are "sorbed" by an ion-exchange mechanism. In order to meet the above criteria, the acid dyeable polymers applied to the textile substrate must have a basisity (cationic charge) in milliequivalents/gram of polymer of from about 0.01 to about 5, preferably from about 0.1 to about 1, such being sufficient to give a color reading of from about 10 to about 100 (percent absorption at a wavelength of 630 mm) after dyeing when compared to an undyed control fabric as measured on a spectrophotometer. Thus, any suitable acid dyeable polymer having the necessary cationic sites and which is capable of forming a film can be employed in the method of the present invention. However, especially desirable results can be obtained when the polymeric backbone of the acid dyeable polymers is polyurethane or a polyamide.

To further illustrate such acid dyeable polymers, e.g. cationic charged polymers, which can be employed in the practice of the present invention the following structural examples are given. In each example the bracketed portion represents the repetitive portion of the polymeric backbone.

Polyurethane

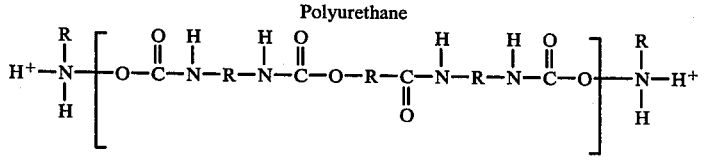

wherein each R is an alkyl, alkene, or cycloalkyl group, such as $-CH_2-$, $-CH_2-CH_2$, $-(CH_2)_3$, $-(CH_2)_4-$, $-CH=CH-CH_2-$, $-CH=CH-(CH_2)_2-$, $-CH=CH-(CH_2)_2-CH_2-$,

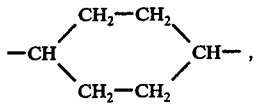

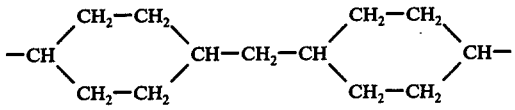

and the like.

Polyamide

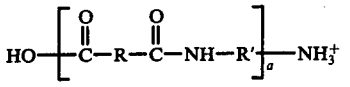

wherein R is an alkyl, alkylene, cycloalkyl or cycloalkylene group, such as $—CH_2—$; $—CH_2—CH_2—$; $—CH_2—CH_2—CH_2—$; $CH_2—(CH_2)_2—CH_2—$; $—CH=CH—$; $—CH=CH—CH_2—$; $—CH=CH—(CH_2)_2—$; $—CH=CH—(CH_2)_2—CH_2—$;

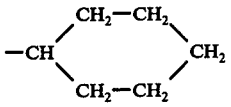

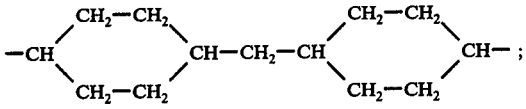

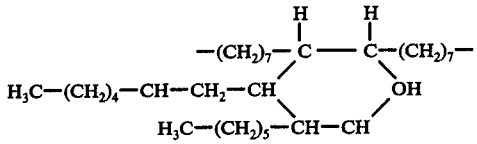

and the like, R′ is an alkyl cycloalyhatic, aromatic or alkyl substituted amine, such as $—(CH_2)—$; $—(CH_2)_2$; $—(CH_2)_3—(CH_2)_2—NH—(CH_2)_2—$; $—(CH_2)_2—NH—(CH_2)_2—NH—(CH_2)_2—NH—(CH_2)_2—$; $—(CH_2)_3—NH—(CH_2)_3$; $—(CH_2)_3—$;

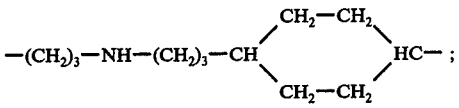

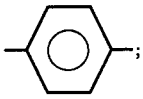

; and

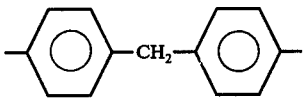

and the like, and $a$ is an integer of from 1 to about 10.

Especially desirable are the polyamides formed by the amination of a polymerized fatty acid, such polyamides being generally represented by the formula

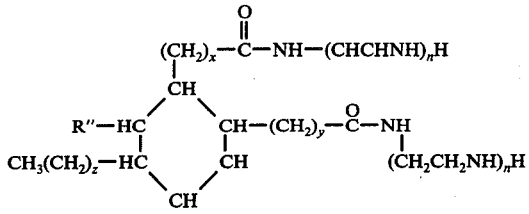

wherein R″ is an alkyl, alkylene, cycloalkyl or cycloalkylene group as defined hereinbefore, $x$, $y$ and $z$ are each integers of from 0 to about 12, and $n$ is an integer of from 1 to about 4. For example, R″ will be $H_3C—(CH_2)_4—CH=CH—CH_2—$ when the polyamide is formed from a dimer acid resulting from the Diels-Alder cyclization reaction between 9, 12 and 9, 11 linoleic acid, $n$ will be 2, $v$ and $y$ will be 7 and $z$ will be 5.

The non-aqueous admixture containing at least 1 weight percent of an acid dyeable polymer can contain up to about 100 percent of the polymer. However, it is generally desirable to employ as the non-aqueous admixture an organic solvent or organic carrier liquid containing from about 1 to about 45 weight percent of the acid dyeable polymer. When employing an organic solvent or organic carrier liquid in the non-aqueous admixture, care must be exercised in the selection of the organic solvent or carrier liquid to ensure that the organic constituent does not react with either the acid dyeable polymer or the textile fabric substrate. Thus, any organic solvent or organic carrier liquid which is substantially inert to the acid dyeable polymer component of the non-aqueous admixture and the textile fabric substrate can be employed. Typical of such organic solvents or organic carrier liquids which can be used in the non-aqueous admixture containing an acid dyeable polyamide polymer in accordance with the present invention are perchloroethylene, benzyl alcohol, kerosene, mineral spirits, carbon tetrachloride, cyclohexane, 1,1,1-trichloroethane, benzene, toluene, xylene and the like. When employing an acid dyeable polyurethane polymer, the same type of organic solvent or organic carrier liquids can be employed, as listed above, except that the alcohol should not be employed as the organic solvent or carrier liquid since the alcohols are not generally inert to the acid dyeable polyurethane polymer.

The viscosity of the non-aqueous admixture containing at least 1 weight percent of the acid dyeable polymer which can be applied to the textile fabric substrate in accordance with the present invention can vary widely. However, it is generally desirable that the viscosity of the non-aqueous admixture be maintained in the range of from about 5 to about 50,000 centipoise (Brookfield #4 Spindle/12 r.p.m.). Especially desirable results can be obtained when the non-aqueous admixture has a viscosity of from about 20 to about 40,000 centipoise.

As previously stated, the essential ingredient of the non-aqueous admixture employed to produce the polymer-printed fabrics with differential dyeing characteristics of the present invention is the acid dyeable polymer. However, in addition to the acid dyeable polymer, it is often desirable to incorporate into the non-aqueous admixture a minor effective amount of a solvent-soluble fugitive tint.

The incorporation of the solvent-soluble fugitive tint into the non-aqueous admixture may be desirable because the non-aqueous admixture applied to the textile fabric substrate, and thus the resulting polymeric design imprinted on the fabric substrate, is substantially colorless. The incorporation of the fugitive tint into the non-aqueous admixture allows one to detect and determine the presence of the polymeric constituent on the substrate after the application of the admixture. The amount of fugitive tint employed can vary widely but is generally employed in an amount of from about 0.1 to about 2 weight percent. The particular fugitive tint employed should be soluble in the non-aqueous admixture and also should be readily removable by a solvent or aqueous scour after dyring and/or curing of the polymeric constituent so as to not interfere with the subsequent dyeing of the dried polymer printed portion of the fabric or result in a discolored product. However, care must be exercised in the selection of the fugitive tint to insure that the tint composition in no way reacts with the acid dyeable polymeric constituent. Typical of such solvent-soluble fugitive tints which can be employed in accordance with the present invention is 2,4 Dinitrophenol and the like.

After application of the non-aqueous admixture containing at least 1 weight percent of the acid dyeable polymer to the textile fabric substrate in desired pattern, the polymer printed substrate is subjected to elevated temperatures for an effective period of time to substantially dry the polymeric constituent on the substrate and thus insure crosslinking of the polymer. The temperature at which the polymer is dried can vary widely but will generally be at a temperature in the range of from about 275° F to about 300° F. The drying step not only suffices in the desired removal of the organic solvent but also insures crosslinking of the polymer and fixes the polymer securely to the textile fabric substrate.

The dried, polymer-printed substrate can then be subjected to other processing steps, such as solvent or aqueous scouring to remove any fugitive tint which may be present on the polymer followed thereafter by washing and drying to effectively remove any unreacted polymer constituents.

The dried, polymer-coated textile fabric substrate is then dryed with a dye admixture containing acid dyestuffs using procedures well known by those skilled in the art. The polymer constituent on the textile fabric substrate receives and takes up the acid dyestuffs whereas the untreated portions of the fabric are substantially resistant to the acid dyestuffs. Thus, after dyeing the dyed pattern on the textile fabric substrate is a result of the dye uptake of the polymeric pattern. After dyeing, the dyed textile material can be further treated to improve the appearance, hand, crockfastness and the like of the dyed material. The desirability of the further treatment of the dyed textile material will be determined largely by the end use for which the dyed textile material is to be employed. If desirable, minor effective amounts of soil release agents, water-proofing agents, mildewcides, softeners and the like can be applied to the surface of the dyed textile material by any suitable means, such being well known in the art.

If desired, the dyebath can contain, in addition to the acid dyestuffs, a dyestuff which is preferential to the untreated or unmodified portion of the textile fabric material. In such instances the acid dyestuff will preferentially dye that portion of the fabric substrate containing the polymeric constituent and the unmodified portion will be preferentially dyed by the other dyestuff to produce a multi-colored or tone-on-tone fabric. The dyes normally employed for the dyeing of the untreated portion of the polymer-printed fabric of the invention are dispersed and cationic dyes, and such dyes are well known in the art.

In addition to the before-mentioned drying step, it may, in some instances, be desirable to subject the polymer-printed textile substrate to a curing step. In such instances, the dried polymer-printed substrate will be subjected to additional heating within the range of from about 275° F to about 300° F for a period of time effective to insure that the desired curing of the polymer has occurred.

In order to further illustrate the present invention, the following examples are given. Such examples are given for the purpose of illustration and are not to be construed as unduly limiting the scope of the present invention as set forth in the claims hereafter. In each of the examples, all parts are parts by weight unless otherwise specified.

EXAMPLE I

A Raschel fabric made from 94% T242 disperse dyeable polyester and 6% nylon was rotary screen printed with a non-aqueous admixture containing 70 weight percent benzyl alcohol and 30 weight percent of a cationic chargeable polyamide (Milvex 4000 polyamide resin). The non-aqueous admixture had a Brookfield viscosity (#4/.6) of 15,000 cps.

The polyamide in this example is a condensation product of a polyamine and a dimer acid. The general (simpliefied) structure of a polyamide is as follows:

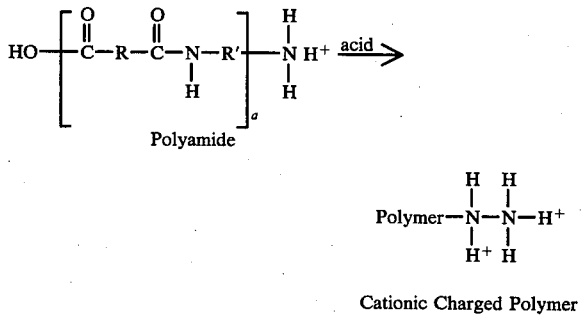

The cationic chargeable polymer-printed fabric was dried at a temperature between 290° - 310° F. The dried fabric was split into four separate pieces and acid dyed using four aqueous dyebaths. The dyebaths with the dried fabric samples contained therein were maintained at the boil for 30 minutes. The dyed, polymer-printed fabrics were then removed from the various dyebaths, rinsed, dried and examined. The resulting products were blue, yellow, gray and green colored patterns on a white, undyed and unstained background.

The various dyebaths employed are as follows. The ingredients of the baths are reported as weight percent based on the weight of the fabric being dyed.

| Dye Formulation Ingredients | Blue | Yellow | Gray | Green |
|---|---|---|---|---|
| 84% Acetic Acid | 1.0 | 1.0 | 1.0 | 1.0 |
| Ammonium Phosphate | 1.5 | 1.5 | 1.5 | 1.5 |
| Intralan Brilliant Yellow 3GL (powder) | 0.0018 | 0.024 | 0.0086 | 0.0187 |
| Irganol Red BL (powder) | 0.00052 | 0.0018 | 0.0032 | 0.0012 |
| Telon Fast Blue ARW (powder) | 0.0220 | 0.0013 | 0.0086 | 0.0077 |

EXAMPLE II

A polyester Raschel fabric similar to that of Example I was rotary screen printed with a non-aqueous admixture containing 60 weight percent toluene and 40 weight percent of a cationic charged polyurethane polymer (cationic charged Urethane Durane 9F 7801). The non-aqueous admixture had a Brookfield viscosity (#4/12 r.p.m.) of 20,000 cps.

The general structure (simplified) of the cationic charged polyurethane polymer is as follows:

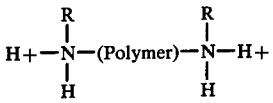

The cationic chargeable polymer-printed fabric was dried and dyed in accordance with the procedures of Example I. After dyeing, the dyed samples were rinsed and dried. The resulting products were blue, yellow, gray and green colored patterns on a white, undyed and unstained background.

The above examples clearly demonstrate the improved fabrics and method for producing same of the present invention. Numerous modifications and variations may be possible by those skilled in the art from a reading of the disclosure without departing from the scope of the invention as set forth in the appended claims.

Having thus described the invention, I claim:

1. A method for imparting a pattern to a textile fabric substrate which comprises:

applying to said substrate, in a pre-determined pattern, a non-aqueous admixture consisting essentially of at least 1 weight percent of an acid dyeable polymer having a cationic charge in milliequivalents/gram of polymer of from about 0.01 to about 5, said non-aqueous admixture having a viscosity of from about 5 to about 50,000 centipoise; drying the polymer-printed substrate; and, dyeing the dried polymer-printed substrate with a dye admixture containing an acid dyestuff preferential to the polymer coated portion of the substrate.

2. The method according to claim 1 wherein said drying is carried out at a temperature of from about 275° F to about 300° F for a period of time effective to insure crosslinking of the polymer and bonding of the polymer to the textile substrate.

3. The method according to claim 2 wherein said non-aqueous admixture includes from about 0.1 to about 2 weight percent of an inert solvent-soluble fugitive tint composition.

4. The method according to claim 3 wherein the dyestuff present in said dye containing admixture is an anionic dyestuff.

5. The method according to claim 4 wherein said dye containing admixture further contains a dyestuff preferential to the untreated portion of the textile substrate.

6. The method according to claim 5 wherein said dye containing solution is maintained at a temperature of from about 190° F to about 212° F and at atmospheric pressure during dyeing of said coated polymer textile material.

7. The method according to claim 6 wherein said acid dyeable polymer is a cationic chargeable polyurethane or polyamide.

8. The method according to claim 1 wherein said non-aqueous admixture consists essentially of from about 1 to about 45 weight percent of said acid dyeable polymer and an inert organic solvent, and said drying of the polymer-printed substrate is carried out at a temperature effective to remove substantially all of the inert organic solvent from the polymer and said textile fabric substrate.

9. The method according to claim 8 wherein said textile fabric substrate is constructed from polyester fibers or blends of such fibers.

10. The method according to claim 9 wherein said drying is carried out at a temperature of from about 275° F to about 300° F for a period of time effective to insure crosslinking of the polymer and bonding of the polymer to the textile substrate.

11. The method according to claim 10 wherein said non-aqueous admixture includes from about 0.1 to about 2 weight percent of an inert solvent-soluble fugitive tint composition.

12. The method according to claim 11 wherein the dyestuff present in said dye containing admixture is an anionic dyestuff.

13. The method according to claim 12 wherein said dye containing admixture further contains a dyestuff preferential to the untreated portion of the textile substrate.

14. The method according to claim 13 wherein said dye containing solution is maintained at a temperature of from about 190° F to about 212° F and at atmospheric pressure during dyeing of said coated polymer textile material.

15. The method according to claim 14 wherein said acid dyeable polymer is polyamide and said solvent is selected from the group consisting of perchloroethylene, benzyl alcohol, kerosene, mineral spirits, carbon tetrachloride, cyclohexane, 1,1,1-trichloroethane, benzene, toluene and xylene.

16. The method according to claim 15 wherein said solvent is benzyl alcohol.

17. The method according to claim 14 wherein said acid dyeable polymer is polyurethane and said solvent is selected from the group consisting of perchloroethylene, kerosene, mineral spirits, carbon tetrachloride, cyclohexane, 1,1,1-trichloroethane, benzene, toluene and xylene.

18. The method according to claim 17 wherein said solvent is toluene.

* * * * *

UNITED STATES PATENT OFFICE

CERTIFICATE OF CORRECTION

Patent No. 4,087,243 Dated May 2, 1978

Inventor(s) Manuel Andrew Thomas and Jerry Albert Cogan, Jr.

It is certified that error appears in the above-identified patent and that said Letters Patent are hereby corrected as shown below:

Column 2, line 31, the word "than" should be --that--.

Column 2, line 39, the letters "mm" should be --nm--.

Column 4, line 4, last part of line, "$(CHCHNH)_nH$" should be --$(CH_2CH_2NH)_nH$--.

Signed and Sealed this

*Twenty-fifth* Day of *December 1979*

[SEAL]

*Attest:*

SIDNEY A. DIAMOND

*Attesting Officer*

*Commissioner of Patents and Trademarks*